US010415427B2

(12) United States Patent
Quennehen et al.

(10) Patent No.: US 10,415,427 B2
(45) Date of Patent: Sep. 17, 2019

(54) TURBINE RING ASSEMBLY COMPRISING A COOLING AIR DISTRIBUTION ELEMENT

(71) Applicant: SAFRAN AIRCRAFT ENGINES, Paris (FR)

(72) Inventors: Lucien Henri Jacques Quennehen, Paris (FR); Sébastien Serge Francis Congratel, La Brosse Montceaux (FR); Clément Jean Pierre Duffau, Paris (FR); Nicolas Paul Tableau, Paris (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 70 days.

(21) Appl. No.: 15/818,121

(22) Filed: Nov. 20, 2017

(65) Prior Publication Data

US 2018/0087401 A1 Mar. 29, 2018

Related U.S. Application Data

(63) Continuation of application No. 15/717,039, filed on Sep. 27, 2017.

(30) Foreign Application Priority Data

Sep. 27, 2016 (FR) ..... 16 01411

(51) Int. Cl.
*F01D 25/24* (2006.01)
*F01D 11/08* (2006.01)
(Continued)

(52) U.S. Cl.
CPC ..... *F01D 25/12* (2013.01); *F01D 11/08* (2013.01); *F01D 11/24* (2013.01); *F01D 25/005* (2013.01);
(Continued)

(58) Field of Classification Search
CPC ..... F01D 25/12; F01D 25/005; F01D 25/246; F01D 25/28; F01D 11/08; F01D 11/24;
(Continued)

(56) References Cited

U.S. PATENT DOCUMENTS 4,303,371 A * 12/1981 Eckert ..... F01D 11/08 415/116
6,702,550 B2 3/2004 Darkins
(Continued)

FOREIGN PATENT DOCUMENTS

EP 2 604 805 A2 6/2013
EP 2 631 434 A2 8/2013
(Continued)

OTHER PUBLICATIONS

Search Report as issued in French Patent Application No. 1601411, dated Jul. 6, 2017.
(Continued)

*Primary Examiner* — Richard A Edgar
(74) *Attorney, Agent, or Firm* — Pillsbury Winthrop Shaw Pittman LLP

(57) ABSTRACT

A turbine ring assembly includes a plurality of ring segments and a ring support structure, the ring assembly further including, for each ring segment, a cooling distribution element fixed to the ring support structure and positioned in a first cavity delimited between the turbine ring and the ring support structure.

8 Claims, 8 Drawing Sheets

(51) Int. Cl.

| | |
|---|---|
| ***F01D 11/24*** | (2006.01) |
| ***F01D 25/00*** | (2006.01) |
| ***F01D 25/12*** | (2006.01) |
| *F01D 25/28* | (2006.01) |

(52) U.S. Cl.
CPC ..... *F01D 25/246* (2013.01); *F01D 25/28* (2013.01); *F05D 2220/32* (2013.01); *F05D 2230/64* (2013.01); *F05D 2230/642* (2013.01); *F05D 2230/644* (2013.01); *F05D 2240/11* (2013.01); *F05D 2250/75* (2013.01); *F05D 2260/221* (2013.01); *F05D 2260/30* (2013.01); *F05D 2300/5021* (2013.01); *F05D 2300/50212* (2013.01); *F05D 2300/6033* (2013.01)

(58) Field of Classification Search
CPC ..... F05D 2220/32; F05D 2230/64; F05D 2230/642; F05D 2230/644; F05D 2240/11; F05D 2250/75; F05D 2260/221; F05D 2260/30; F05D 2300/5021; F05D 2300/50212; F05D 2300/6033
See application file for complete search history.

(56) References Cited

U.S. PATENT DOCUMENTS

| | | | |
|---|---|---|---|
| 6,877,952 | B2 | 4/2005 | Wilson |
| 6,997,673 | B2 | 2/2006 | Morris |
| 7,494,317 | B2 | 2/2009 | Keller |
| 7,722,317 | B2 | 5/2010 | Schiavo |
| 7,726,936 | B2 | 6/2010 | Keller |
| 8,246,299 | B2 | 8/2012 | Razzell |
| 9,175,579 | B2 | 11/2015 | Franks |
| 9,587,517 | B2 | 3/2017 | Vetters |
| 9,726,043 | B2 | 8/2017 | Franks |
| 9,874,104 | B2 | 1/2018 | Shapiro |
| 9,926,799 | B2 | 3/2018 | Romanov |
| 2003/0133790 | A1 | 7/2003 | Darkins |
| 2004/0071548 | A1 | 4/2004 | Wilson |
| 2005/0129499 | A1 | 6/2005 | Morris et al. |
| 2006/0292001 | A1 | 12/2006 | Keller |
| 2007/0077141 | A1 | 4/2007 | Keller |
| 2008/0178465 | A1 | 7/2008 | Schiavo |
| 2008/0206046 | A1 | 8/2008 | Razzell |
| 2010/0104426 | A1 | 4/2010 | Keller |
| 2012/0027572 | A1 | 2/2012 | Denece et al. |
| 2013/0156550 | A1 | 6/2013 | Franks |
| 2013/0156556 | A1 | 6/2013 | Franks et al. |
| 2016/0186611 | A1 | 6/2016 | Vetters |
| 2016/0251982 | A1 | 9/2016 | Shapiro |
| 2017/0022840 | A1 | 1/2017 | Thomas |
| 2017/0101881 | A1 | 4/2017 | Romanov |
| 2017/0114670 | A1 | 4/2017 | Shapiro |
| 2017/0198607 | A1 | 7/2017 | Shapiro |
| 2018/0073398 | A1 | 3/2018 | Quennehen |
| 2018/0156068 | A1 | 6/2018 | Roussille |
| 2018/0156069 | A1 | 6/2018 | Quennehen |
| 2018/0363507 | A1 | 12/2018 | Roussille |
| 2018/0371948 | A1 | 12/2018 | Lepretre |
| 2019/0040761 | A1 | 2/2019 | Carlin |

FOREIGN PATENT DOCUMENTS

| | | | |
|---|---|---|---|
| EP | 2 728 255 | A1 | 5/2014 |
| EP | 3 061 924 | A1 | 8/2016 |
| WO | WO 2006/136755 | A2 | 12/2006 |
| WO | WO 2015/191169 | A1 | 12/2015 |
| WO | WO 2015/191174 | A1 | 12/2015 |
| WO | WO 2015/191186 | A1 | 12/2015 |

OTHER PUBLICATIONS

Notice of Allowance as issued in U.S. Appl. No. 15/717,039, dated May 14, 2019.

Notice of Allowance as issued in U.S. Appl. No. 15/818,039, dated May 8, 2019.

* cited by examiner

TURBINE RING ASSEMBLY COMPRISING A COOLING AIR DISTRIBUTION ELEMENT

CROSS-REFERENCE TO RELATED APPLICATIONS

This application is a continuation of U.S. application Ser. No. 15/717,039, filed Sep. 27, 2017, which in turn claims priority to French Patent Application No. 1601411, filed Sep. 27, 2016, the entire contents of which are incorporated herein by reference in their entireties.

FIELD

The invention relates to a turbine ring assembly comprising a plurality of ring segments made of ceramic matrix composite material (CMC material) or of metal material.

The field of application of the invention is in particular that of gas turbine aeronautical engines. The invention is however applicable to other turbomachines, for example industrial turbines.

BACKGROUND

In gas turbine aeronautical engines, the improvement of efficiency and reduction of certain polluting emissions leads to the search for and operation at increasingly higher temperatures. In the case of entirely metal turbine ring assemblies, it is necessary to cool all the elements of the assembly and in particular the turbine ring which is subjected to very hot flows. The cooling of a metal turbine ring requires the use of a large quantity of cooling air, which has a significant impact on the performance of the engine since the cooling flow used is taken from the main flow of the engine.

The use of ring segments made of CMC material has been proposed in order to limit the ventilation necessary to the cooling of the turbine ring and thus increase the performance of the engine.

However, even if ring segments made of CMC are used, there is still a need to use a significant quantity of cooling air. The turbine ring is, in fact, confronted with a hot source (the duct in which the hot gas flow flows) and a cold source (the cavity delimited by the ring and the casing, hereinafter designated by the expression "ring cavity"). The ring cavity has to be at a higher pressure than that of the duct in order to avoid gas originating from the duct returning to this cavity and burning the metal pieces. This pressurization is obtained by taking "cold" air at the compressor, which has not passed through the combustion chamber, and routing it to the ring cavity. Maintaining such a pressurization therefore makes it impossible to totally cut off the supply of "cold" air from the ring cavity.

Furthermore, studies conducted by the Applicant have shown that a ring, made of CMC or metal material, cooled by known cooling systems, can exhibit detrimental thermal gradients which generate unfavourable mechanical stresses. In addition, the cooling technologies used for a metal ring cannot easily be transposed to a ring made of CMC material.

Whatever the nature of the material implemented for the ring segments, it would therefore be desirable to refine the existing cooling systems in order to limit the unfavourable thermal gradients in the cooled ring segments and therefore the generation of unfavourable stresses. It would, in addition, be desirable to refine the existing cooling systems in order to optimize the quantity of cooling air actually used for the cooling of the ring by limiting in particular the leaks of cooling air.

The invention aims specifically to address the abovementioned needs.

SUMMARY

To this end, the invention proposes, according to a first aspect, a turbine ring assembly comprising a plurality of ring segments made of ceramic matrix composite material or of metal material forming a turbine ring and a ring support structure, each ring segment having, along a cutting plane defined by an axial direction and a radial direction of the turbine ring, a part forming an annular base with, in the radial direction of the turbine ring, an internal face defining the internal face of the turbine ring and an external face from which extend a first and a second attachment tabs, the ring support structure comprising a first and a second radial tabs between which are held the first and second attachment tabs of each ring segment, as well as a plurality of cooling air supply orifices, the turbine ring assembly further comprising, for each ring segment, a cooling air distribution element fixed to the ring support structure and positioned in a first cavity delimited between the turbine ring and the ring support structure, the distribution element comprising a body defining an internal cooling air distribution volume and comprising a multi-perforated plate communicating with the internal volume and emerging in a second cavity delimited between the turbine ring and the multi-perforated plate, the distribution element further comprising at least one cooling air guiding portion extending from the body and defining an internal channel communicating with one of the cooling air supply orifices and emerging in the internal cooling air distribution volume.

The axial direction of the turbine ring corresponds to the direction along the axis of revolution of the turbine ring and to the direction of flow of the gaseous flow in the duct. The radial direction corresponds, for its part, to the direction along a radius of the turbine ring (straight line linking the centre of the turbine ring to its periphery).

The implementation, for each ring segment, of a cooling air distribution element as described above offers several benefits.

First of all, the internal channel defined by the guiding portion of the distribution element is situated in the extension of the cooling air supply orifice of the ring support structure, which makes it possible to optimize the fraction of cooling air actually transferred into the internal cooling air distribution volume. In this way, the quantity of cooling air transmitted to the multi-perforated plate which is, after passing through this plate, transmitted to the ring segments, is maximized. That thus makes it possible to optimize the cooling of the ring segments. In particular, the implementation of the distribution element makes it possible to use the cooling air more efficiently than a traditional multi-perforated metal steel plate, welded to the ring segment, and without the guiding portion described above. In effect, with such a multi-perforated steel plate and despite the welding, the cooling air, because of other leaks, will not all pass through the steel plate. A significant part of the cooling potential of the ring segments is thus lost when the guiding portion is omitted. The implementation of the distribution element thus makes it possible to optimize the quantity of cooling air actually used for the cooling of the ring by limiting the leaks.

In addition, when such a multi-perforated metal steel plate is welded onto ring segments made of CMC material, the seal-tightness at the weld level can be affected during operation because of the differences in degree of expansion between the metal steel plate and the ring segment. The expansion differences can even, in some cases, culminate in a break of the welding leading to a separation between the metal steel plate and the ring segment. Thus, by fixing the cooling air distribution element to the ring support structure, these problems which can be encountered with the multi-perforated steel plate are beneficially overcome.

Finally, the inventors have determined that it was beneficial to obtain, at the ring segment level, a thermal gradient that is as radial as possible, and therefore limit, even eliminate, the axial and tangential thermal gradient. The implementation of the distribution element described above which is provided with a multi-perforated plate is useful regarding this aspect. In effect, the cooling air is accelerated when it passes through the multi-perforated plate and, as consequence, the heat exchange with the ring segment situated facing the plate is optimized. That makes it possible to limit the axial and tangential thermal gradients and therefore to limit the occurrence of unfavourable mechanical stresses in the ring segments.

In one embodiment, the body of the distribution element extends along a circumferential direction of the turbine ring and the multi-perforated plate emerges between the first and second attachment tabs of the ring segment.

In one embodiment, the distribution element comprises at least one holding element extending along the radial direction of the turbine ring and coming to bear against the ring segment so as to hold the latter in position in the radial direction.

Such a feature is beneficial because it makes it possible to exploit the presence of the distribution element to produce not only an effective cooling of the turbine ring but also improve the holding thereof in position in operation.

In one embodiment, the distribution element is fixed to the ring support structure by at least one added element cooperating with an orifice defined by the cooling air guiding portion and extending along the axial direction and/or by at least one added element cooperating with a housing defined by the body of the distribution element and extending along the radial direction.

Aspects of the invention can notably be applied to three beneficial examples of turbine ring assemblies which will now be described.

First Example of Turbine Ring Assembly

This first example of turbine ring assembly is such that it comprises, for each ring segment, at least three pins for radially holding the ring segment in position, at least two of the pins cooperating with one of the first or second attachment tabs of the ring segment and the corresponding first or second radial tab of the ring support structure, and at least one of the pins cooperating with the other attachment tab of the ring segment and the corresponding radial tab of the ring support structure, the first radial tab comprising a first annular radial portion secured to the ring support structure and a removable second annular radial portion extending radially towards the centre of the turbine ring over a greater part than the first annular radial portion, the part extending beyond the first annular radial portion comprising first orifices for receiving one of the pins.

The removable nature of the second annular radial portion in relation to the first annular radial portion secured to the ring support structure makes it possible to have an axial access to the cavity of the turbine ring. That makes it possible to simplify the mounting of the ring segments.

The first example of turbine ring assembly beneficially makes it possible to hold each ring segment deterministically, that is to say control its position and prevent it from vibrating. This ring assembly makes it possible to improve the seal-tightness between the non-duct segment and the duct segment, simplify handling operations by reducing their number for the mounting of the ring assembly, and to allow the ring to be deformed under the effects of temperature and pressure in particular independently of the metal pieces at the interface.

According to a first embodiment of this first example, the removable second annular radial portion comprises an annular flange comprising a first portion bearing against the first attachment tab, a second portion removably fixed to the first annular radial portion and a third portion positioned between the first and the second portions and comprising the first orifices for receiving one of the pins, the third portion and the first portion of the annular flange extending beyond the first annular radial portion.

Given that the first portion and the third portion of the first annular flange extend beyond the first annular radial portion of the first radial tab, the space remaining free when the flange is removed allows an axial introduction of the ring segments into the ring support structure.

According to a second embodiment of this first example, the annular flange is made up of a single part.

The fact of having an annular flange made of a single part, that is to say describing all of a ring over 360°, makes it possible, compared to a segmented annular flange, to limit the passage of the air flow between the non-duct segment and the duct segment, in as much as all the inter-segment leaks are eliminated, and therefore to optimize the seal-tightness.

According to a third embodiment of the first example of turbine ring assembly, the first and second attachment tabs of each ring segment each comprise a first end secured to the external face of the annular base, a second free end, at least one lug for receiving a pin, each lug extending protrudingly from the second end of one of the first or second attachment tabs in the radial direction of the turbine ring, each reception lug comprising an orifice for receiving a pin.

The lugs produced protrudingly radial from the free ends of the first and second attachment tabs make it possible to distance the area of holding of the attachment tabs in relation to the bearing areas lying between the two ends of the attachment tabs and intended to produce a seal-tight contact, on the one hand, with the first portion of the annular flange, and, on the other hand, with the second radial tab of the ring support structure. Furthermore, separating the pin reception area from the bearing areas makes it possible to optimize the seal-tightness by reducing discontinuities of the bearing areas.

According to a fourth embodiment of this first example, the removable second annular radial portion comprises, for each ring segment, at least one second and one third orifices each receiving an added element, the added element received in the second orifice passing through the first annular radial portion and the added element received in the third orifice being housed in an orifice defined by the guiding portion of the cooling air distribution element so as to ensure the fixing of the distribution element to the ring support structure.

According to a fifth embodiment of the first example of turbine ring assembly, the second radial tab of the ring support structure comprises an annular collar comprising a first portion bearing against the second attachment tab, a second portion thinned in relation to the first portion and a third portion positioned between the first and the second portions and comprising orifices for receiving a pin.

The reduction of the thickness of the second portion of the downstream annular collar makes it possible to provide this collar with flexibility and thus not excessively stress the ring segments.

It is also possible to produce an axial prestressing of the annular collar of the second radial tab by making an interference of a few tenths of millimeters. That makes it possible to take up the expansion differences between the metal elements and the ring segments made of CMC when the latter are used.

According to a sixth embodiment of the first example of turbine ring assembly, each distribution element comprises at least two holed blocks each extending in the axial direction and staggered along a circumferential direction of the turbine ring, the blocks being positioned radially outward in relation to the first and second attachment tabs of the ring segment, the holes of these blocks each receiving a pin extending along the radial direction and making it possible to hold the first and second attachment tabs of the ring segment in position in the radial direction.

Such a feature is beneficial because it makes it possible to exploit the presence of the distribution element to produce not only an effective cooling of the turbine ring but also improve the holding thereof in position in operation.

According to a seventh embodiment of the first example of turbine ring assembly, each ring segment comprises rectilinear bearing surfaces present on the faces of the first and second attachment tabs in contact respectively with the annular collar and the annular flange.

The rectilinear bearings make it possible to have controlled seal-tightness areas because a bearing on a continuous line makes it possible not to have leaks. More specifically, having bearings on radial planes makes it possible to overcome effects of straightening in the turbine ring.

Moreover, the rings in operation rock about a normal to the plane comprising the axial direction and the radial direction of the turbine ring. A curvilinear bearing would generate a contact between the ring and the ring support structure made of metal on one or two points. Conversely, a rectilinear bearing allows a bearing on a line.

In a variant, for each ring segment, the faces of the annular collar and the annular flange in contact with the first and second attachment tabs comprise rectilinear bearing surfaces. Each rectilinear bearing surface can comprise a groove hollowed out over all of the length of the bearing surface and a seal inserted into the groove to improve the seal-tightness. The seal and the groove can be present on the first and second attachment tabs of each ring segment or, as a variant, on the annular collar and on the annular flange.

According to an eighth embodiment of the first example of turbine ring assembly, the first radial tab of the ring support structure can further comprise a second annular flange comprising a first portion and a second portion, the second portion being coupled to the first annular radial portion and to the second portion of the first annular flange, the first portion of the second annular flange being remote, in the axial direction of the turbine ring, from the first portion of the first annular flange.

The second annular flange is dedicated to taking up the load of the high-pressure distributor, also denoted DHP. This annular flange makes it possible to take up this load, on the one hand, by being deformed, and, on the other hand, by transferring this load to the most mechanically robust casing line.

In effect, leaving a space between the first portion of the second annular flange and the first portion of the first annular flange makes it possible to deflect the load received by the second annular flange, upstream of the first annular flange in relation to the direction of the gas flow, and to transfer it directly to the central crown ring of the ring support structure via the second portion of the second annular flange, without impacting the first portion of the first annular flange bearing against the first attachment tab of the ring. Since the first portion of the first annular flange is not subjected to any load, the turbine ring is thus preserved from this axial load.

According to a ninth embodiment of the first example of turbine ring assembly, the ring assembly can further comprise, for each ring segment, at least one fixing screw passing through the first and second annular flanges and the first annular radial portion, and at least one fixing nut cooperating with the at least one fixing screw to fix the first and second annular flanges to the first annular radial portion.

Second Example of Turbine Ring Assembly

This second example of turbine ring assembly is such that the first and second attachment tabs extend in the radial direction of the turbine ring and each have a first end secured to the external face and a second free end, each ring segment comprising a third and a fourth attachment tabs each extending in the axial direction of the turbine ring between the second end of the first attachment tab and the second end of the second attachment tab, each ring segment being fixed to the ring support structure by a fixing screw comprising a screw head bearing against the ring support structure and a threading cooperating with a tapping produced in a fixing plate, the fixing plate cooperating with the third and fourth attachment tabs.

The solution defined above for the ring assembly makes it possible to hold each ring segment deterministically, that is to say control its position and prevent it from vibrating, while allowing the ring segment, and by extension the ring, to be deformed under the effects of temperature and pressure in particular independently of the metal pieces at the interface.

According to a first embodiment of this second example, the fixing plate comprises a first and a second ends opposite one another in the circumferential direction and respectively bearing against the third attachment tab and the fourth attachment tab, the first end comprising a first shoulder bearing against the third attachment tab and the second end comprising a second shoulder bearing against the fourth attachment tab, the first and the second shoulders each extending in the axial and radial directions.

The first and second shoulders of the fixing plate make it possible to provide abutments preventing the tangential rotation of the ring, or of the ring segment, about its axis.

According to a second embodiment of this second example, the ring support structure can comprise a first and a second annular collars, the first annular collar being upstream of the second annular collar in relation to the direction of the air flow intended to pass through the turbine ring assembly, and the first and second attachment tabs of each ring segment being held between the two annular collars of the ring support structure, the second annular collar comprising a portion thinned in relation to the rest of the second annular collar, the portion thinned being arranged between a portion bearing against the second attachment tab and an end of the second annular collar secured to the rest of the ring support structure.

The first and second annular collars of the ring support structure make it possible to hold the position of the ring segment in the axial direction of the turbine ring.

Furthermore, the reduction of the thickness of the second annular collar, that is to say the downstream collar, makes it possible to provide the secondary collar with flexibility and thus not excessively stress the ring segment.

According to a third embodiment of this second example, the ring support structure can comprise a first annular flange and a second annular flange fixed to the first annular collar, the first and second annular flanges being therefore able to be dismantled from the first annular collar, the first annular flange being bearing against the first attachment tab, and the second annular flange comprising a first free end and a second end coupled to the first annular flange, the first end being at a distance, in the axial direction of the turbine ring, from the first annular flange.

The removable nature of the first annular flange makes it possible to have an axial access to the cavity of the turbine ring. That makes it possible to simplify the mounting of the ring segments.

According to a fourth embodiment of this second example, each ring segment can comprise rectilinear bearing surfaces present on the faces of the first and second attachment tabs in contact respectively with the second annular collar and the first annular flange.

As mentioned above for the first example, the rectilinear bearings make it possible to have controlled seal-tightness areas.

In a variant, for each ring segment, the faces of the second annular collar and of the first annular flange in contact with the first and second attachment tabs comprise rectilinear bearing surfaces.

Each rectilinear bearing surface can comprise a groove hollowed out over all of the length of the bearing surface and a seal inserted into the groove to improve the seal-tightness. The seal and the groove can be present on the first and second attachment tabs of each ring segment or, as a variant, on the second annular collar and on the first annular flange.

According to a fifth embodiment of this second example, the third attachment tab and the fourth attachment tab can each be cut into two independent portions, each of the third and fourth attachment tabs comprising a first portion coupled to the first attachment tab and a second portion coupled to the second attachment tab.

The production of each of the third and fourth attachment tabs in the form of two independent portions coupled respectively to the first and second attachment tabs makes it possible for the upstream and downstream parts of each ring segment, and therefore of the turbine ring, to be mechanically dissociated and thus not strain one another.

According to a sixth embodiment of this second example, the third and fourth attachment tabs are each coupled to the first and second attachment tabs respectively by a first and a second ends extending protrudingly, in the radial direction of the turbine ring, in the extension of the first and second attachment tabs so as to raise the third and fourth attachment tabs in relation to the second ends of the first and second attachment tabs.

According to a seventh embodiment of this second example, the distribution element comprises a fixing portion situated radially outward in relation to the multi-perforated plate and secured to the fixing plate.

Third Example of Turbine Ring Assembly

This third example of turbine ring assembly is such that each ring segment has, in cross section along the plane defined by the axial and radial directions, the form of a K, the first and second attachment tabs each having the form of an S, the first radial tab comprising a first and a second holding elements on which rests the internal face in the radial direction of the first attachment tab of each ring segment, the external face in the radial direction of the turbine ring of the first attachment tab of each ring segment being in contact with a first and a second tightening elements secured to the ring support structure, the first and second tightening elements being respectively facing the first and second holding elements in the radial direction, the second radial tab comprising a third holding element on which rests the internal face in the radial direction of the second attachment tab of each ring segment, the external face in the radial direction of the turbine ring of the second attachment tab of each ring segment being in contact with a third tightening element secured to the ring support structure, the third tightening element being facing the third holding element in the radial direction.

The solution proposed in this third example makes it possible to hold the ring segments without play at the level of their cold mounting on the ring support structure, the ring segments being held, on the one hand, by the contact between the internal face of the tabs of the ring segments and the holding elements secured to the annular collars of the ring support structure and, on the other hand, by the contact between the external face of the tabs of the ring segments and the tightening elements secured to the ring support structure.

According to a first embodiment of this third example, the first and second holding elements of the first radial tab are present in the vicinity of the circumferential ends of each ring segment whereas the third holding element of the second radial tab is present in the vicinity of the median part of each ring segment.

A balanced holding of each ring segment is thus assured while having an overall bearing surface on the ring segments that is significantly reduced, which makes it possible to reduce the weight of the turbine ring assembly and to reduce the areas of application of any stresses on the ring segments during thermal expansions.

According to a second embodiment of this third example, the internal face in the radial direction of the turbine ring of the second tab of each ring segment further rests on a fourth holding element secured to the second annular radial tab, the external face in the radial direction of the turbine ring of the second tab of each ring segment being in contact with a fourth tightening element secured to the ring support structure, the fourth tightening element being facing the fourth holding element in the radial direction of the turbine ring, and in which the first and second holding elements secured to the first annular radial tab and the third and fourth holding elements secured to the second annular radial tab are present in the vicinity of the circumferential ends of each ring segment.

In this case, a balanced holding of each ring segment is also assured while having an overall bearing surface on the ring segments that is significantly reduced, which makes it possible to reduce the weight of the turbine ring assembly and to reduce the areas of application of any stresses on the ring segments during thermal expansions.

According to a third embodiment of this third example, the first, second, third and possibly fourth tightening elements are formed respectively by first, second, third and possibly fourth pins secured to the ring support structure. The pins can notably be screwed or shrink-fitted in the ring support structure to hold them in position.

According to a fourth embodiment of this third example, the first and second attachment tabs of each ring segment extend in a rectilinear direction whereas the annular face of each ring segment extends in the circumferential direction of the ring.

Thus, the ring has rectilinear bearings at the level of the contact with the ring support structure. That makes it possible to have controlled seal-tightness areas.

According to a fifth embodiment of this third example, the areas of contact between the holding elements and the attachment tabs lie in one and the same rectilinear plane and the areas of contact between the attachment tabs and the tightening elements lie in one and the same rectilinear plane.

This alignment of the areas of contact on parallel rectilinear planes makes it possible to retain lines of seal-tightness in case of rocking of the ring.

According to a sixth embodiment of this third example, the ring assembly further comprises an upstream flange mounted on the first radial tab, the upstream flange comprising a plurality of first and second holding elements evenly distributed over the face of the flange facing the first tabs of the ring segments.

As a variant, the ring assembly comprises an upstream flange mounted on the second radial tab, the upstream flange comprising at least a plurality of third holding elements evenly distributed over the face of the flange facing the second tabs of the ring segments.

The use of a flange makes it possible to facilitate the mounting of the ring segments on the ring support structure.

According to a seventh embodiment of this third example, the second radial tab is elastically deformable. That makes it possible not to exert excessive stresses on the ring segments.

Another aspect of the present invention also targets a turbomachine comprising a turbine ring assembly as described above.

BRIEF DESCRIPTION OF THE DRAWINGS

Other features and benefits of the invention will emerge from the following description of particular embodiments of the invention, given as non-limiting examples with reference to the attached drawings, in which.

DETAILED DESCRIPTION

Figure 1:
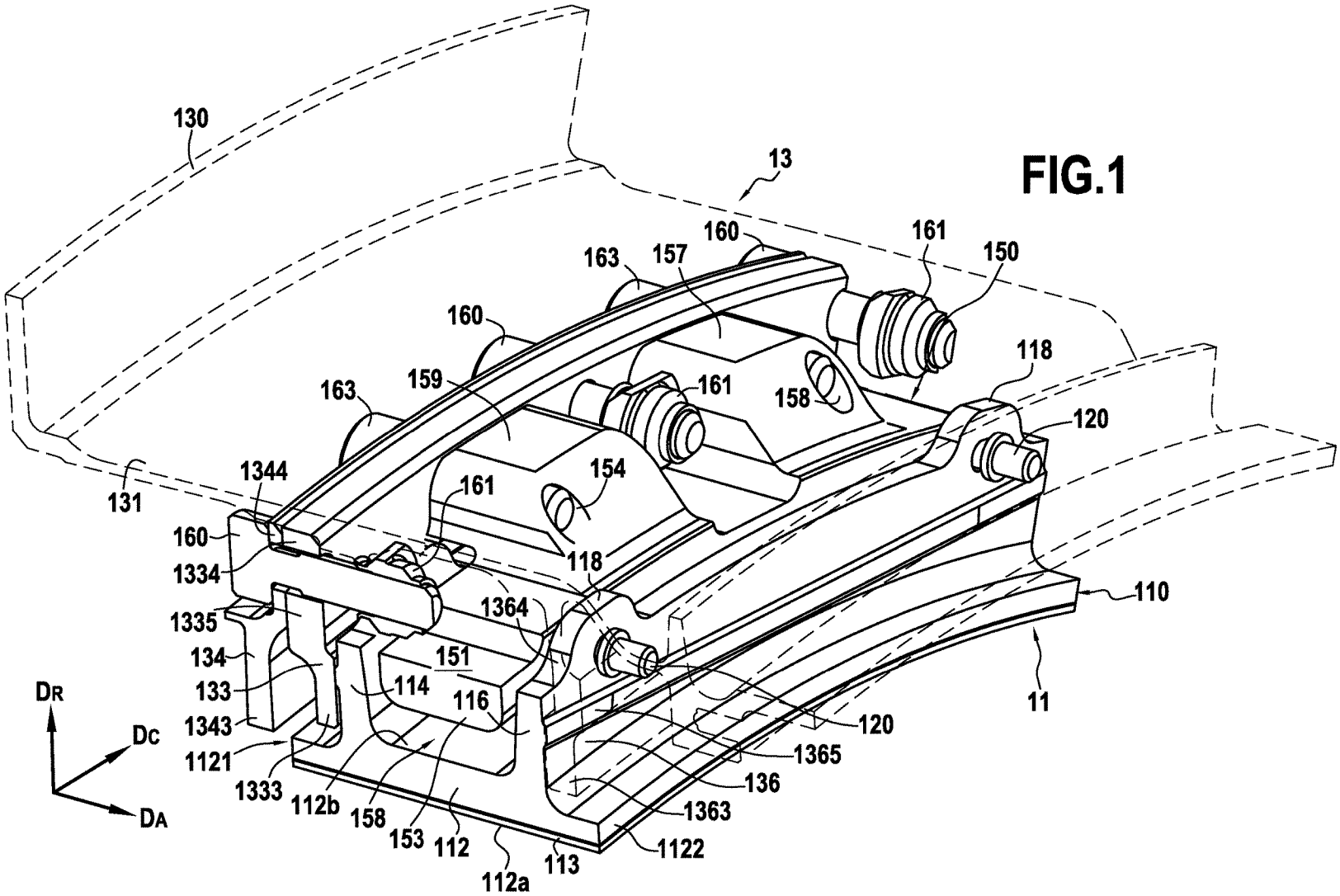
FIG. 1 is a perspective schematic view of an embodiment of a turbine ring assembly according to the first example described above.

Description of a First Embodiment of the First Example of Turbine Ring Assembly FIG. 1 shows a high-pressure turbine ring assembly comprising a turbine ring 11 made of ceramic matrix composite material (CMC) or of metal material and a metal ring support structure 13. When the ring 11 is made of CMC, the ring support structure 13 is made of a material having a thermal expansion coefficient higher than the thermal expansion coefficient of the material forming the ring segments. The turbine ring 11 surrounds a set of rotating blades (not represented). The turbine ring 11 is formed of a plurality of ring segments 110. The arrow $D_A$ indicates the axial direction of the turbine ring 11 whereas the arrow $D_R$ indicates the radial direction of the turbine ring 11. The arrow $D_C$, for its part, indicates the circumferential direction of the turbine ring 11. For the purposes of simplifying the presentation, FIG. 1 is a partial view of the turbine ring 11 which is in reality a complete ring.

Figure 2:
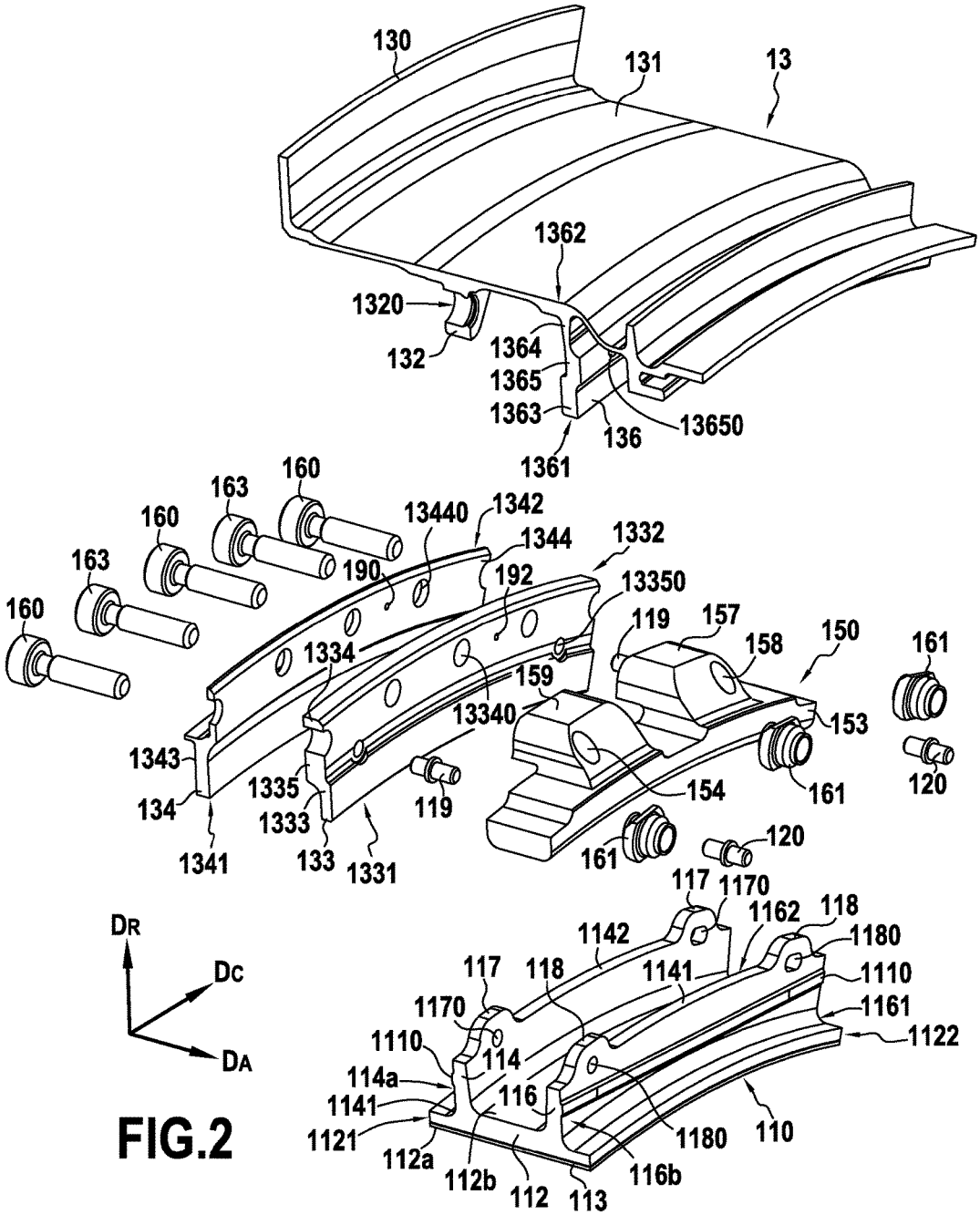
FIG. 2 is an exploded perspective schematic view of the turbine ring assembly of FIG. 1.

As illustrated in FIG. 2, which presents an exploded perspective schematic view of the turbine ring assembly of FIG. 1, each ring segment 110 has, along a plane defined by the axial $D_A$ and radial $D_R$ directions, a section substantially in the form of the Greek letter $\pi$ inverted. The segment 110 in effect comprises an annular base 112 and upstream and downstream radial attachment tabs 114 and 116. The terms "upstream" and "downstream" are used here with reference to the direction of flow of the gaseous flow in the turbine which takes place along the axial direction $D_A$.

The annular base 112 comprises, in the radial direction $D_R$ of the ring 11, an internal face 112*a* and an external face 112*b* opposite one another. The internal face 112*a* of the annular base 112 is coated with a layer 113 of abradable material forming a thermal and environmental barrier and defines a flow duct of gaseous flow in the turbine.

The upstream and downstream radial attachment tabs 114 and 116 extend protrudingly, in the direction $D_R$, from the external face 112*b* of the annular base 112 at a distance from the upstream and downstream ends 1121 and 1122 of the annular base 112. The upstream and downstream radial attachment tabs 114 and 116 extend over all the circumferential length of the ring segment 110, that is to say over all the circular arc described by the ring segment 110.

As is illustrated in FIGS. 1 and 2, the ring support structure 13 which is secured to a turbine casing 130 comprises a central crown ring 131, extending in the axial direction $D_A$, and having an axis of revolution coinciding with the axis of revolution of the turbine ring 11 when they are fixed together. The ring support structure 13 further comprises an upstream annular radial collar 132 and a downstream annular radial collar 136 which extend, in the radial direction $D_R$, from the central crown ring 31 to the centre of the ring 11 and in the circumferential direction of the ring 11.

As is illustrated in FIG. 2, the downstream annular radial collar 136 comprises a first free end 1361 and a second end 1362 secured to the central crown ring 131. The downstream annular radial collar 136 comprises a first portion 1363, a second portion 1364, a third portion 1365 lying between the first portion 1363 and the second portion 1364. The first portion 1363 extends between the first end 1361 and the third portion 1365, and the second portion 1364 extends between the third portion 1365 and the second end 1362. The first portion 1363 of the annular radial collar 136 is in contact with the downstream radial attachment tab 116. The second portion 1364 is thinned in relation to the first portion 1363 and the third portion 1365 so as to give the annular radial collar 136 a certain flexibility and thus not excessively stress the turbine ring 11.

As is illustrated in FIGS. 1 and 2, the ring support structure 13 further comprises a first and a second upstream flanges 133 and 134 each having, in the example illustrated, an annular form. The two upstream flanges 133 and 134 are fixed together on the upstream annular radial collar 132. As a variant, the first and second upstream flanges 133 and 134 could be segmented into a plurality of ring segments.

The first upstream flange 133 comprises a first free end 1331 and a second end 1332 in contact with the central crown ring 131. The first upstream flange 133 further comprises a first portion 1333 extending from the first end 1331, a second portion 1334 extending from the second end 1332, and a third portion 1335 extending between the first portion 1333 and the second portion 1334.

The second upstream flange 134 comprises a first free end 1341 and a second end 1342 in contact with the central crown ring 131, and a first portion 1343 and a second portion 1344, the first portion 1343 extending between the first end 1341 and the second portion 1344, and the second portion 1344 extending between the first portion 1343 and the second end 1342.

The first portion 1333 of the first upstream flange 133 is bearing on the upstream radial attachment tab 114 of the ring segment 110. The first and second upstream flanges 133 and 134 are conformed to have the first portions 1333 and 1343 at a distance from one another and the second portions 1334 and 1344 in contact, the two flanges 133 and 134 being fixed removably onto the upstream annular radial collar 132 using fixing screws 160 and nuts 161, the screws 160 passing through orifices 13340, 13440 and 1320 provided respectively in the second portions 1334 and 1344 of the two upstream flanges 133 and 134 and in the upstream annular radial collar 132. The nuts 161 are, for their part, secured to the ring support structure 13, being for example fixed by crimping thereto.

The second upstream flange 134 is dedicated to taking up the load of the high-pressure distributor (DHP), on the one hand, by being deformed, and, on the other hand, by transferring this load to the most mechanically robust casing line, that is to say to the line of the ring support structure 13.

In the axial direction $D_A$, the downstream annular radial collar 136 of the ring support structure 13 is separated from the first upstream flange 133 by a distance corresponding to the spacing of the upstream and downstream radial attachment tabs 114 and 116 so as to hold the latter between the downstream annular radial collar 136 and the first upstream flange 133. It is possible to produce an axial prestressing of the collar 136. That makes it possible to take up the expansion differences between the metal elements and the ring segments made of CMC when the latter are used.

To provide a better hold of the ring segments 110, and therefore the turbine ring 11, in position with the ring support structure 13, the ring assembly comprises, in the example illustrated, two first pins 119 cooperating with the upstream attachment tab 114 and the first upstream flange 133, and two second pins 120 cooperating with the downstream attachment tab 116 and the downstream annular radial collar 136.

For each corresponding ring segment 110, the third portion 1335 of the first upstream flange 133 comprises two orifices 13350 for receiving the two first pins 119, and the third portion 1365 of the annular radial collar 136 comprises two orifices 13650 configured to receive the two second pins 120.

For each ring segment 110, each of the upstream and downstream radial attachment tabs 114 and 116 comprises a first end, 1141 and 1161, secured to the external face 112*a* of the annular base 112 and a second free end, 1142 and 1162. The second end 1142 of the upstream radial attachment tab 114 comprises two first lugs 117 each comprising an orifice 1170 configured to receive a first pin 119. Similarly, the second end 1162 of the downstream radial attachment tab 116 comprises two second lugs 118 each comprising an orifice 1180 configured to receive a second pin 120. The first and second lugs 117 and 118 extend protrudingly in the radial direction $D_R$ of the turbine ring 11 respectively from the second end 1142 of the upstream radial attachment tab 114 and from the second end 1162 of the downstream radial attachment tab 116.

For each ring segment 110, the two first lugs 117 are positioned at two different angular positions in relation to the axis of revolution of the turbine ring 11. Similarly, for each ring segment 110, the two second lugs 118 are positioned at two different angular positions in relation to the axis of revolution of the turbine ring 11.

Each ring segment 110 further comprises rectilinear bearing surfaces 1110 mounted on the faces of the upstream and downstream radial attachment tabs 114 and 116 in contact respectively with the first upstream annular flange 133 and the downstream annular radial collar 136, that is to say on the upstream face 114*a* of the upstream radial attachment tab 114 and on the downstream face 116*b* of the downstream radial attachment tab 116. In a variant, the rectilinear bearings could be mounted on the first upstream annular flange 133 and on the downstream annular radial collar 136.

The rectilinear bearings 1110 make it possible to have controlled seal-tightness areas. In effect, the bearing surfaces 1110 between the upstream radial attachment tab 114 and the first upstream annular flange 133, on the one hand, and between the downstream radial attachment tab 116 and the downstream annular radial collar 136 lie in one and the same rectilinear plane.

More specifically, having bearings on radial planes makes it possible to overcome the effects of straightening in the turbine ring 11. Moreover, the rings in operation rock about a normal to the plane ($D_A$, $D_R$). A curvilinear bearing would generate a contact between the ring 11 and the ring support structure 13 on one or two points. Conversely, a rectilinear bearing allows for a bearing on a line.

As mentioned above, the ring assembly further comprises, for each ring segment 110, a cooling air distribution element 150. This distribution element 150 constitutes a diffuser allowing a cooling flow $F_R$ to impact on the external face 112*b* of the ring segment 110. The element 150 is present in a first cavity 151 delimited between the turbine ring 11 and the ring support structure 13. The distribution element 150 comprises a hollow body 153 which defines an internal cooling air distribution volume V and a multi-perforated plate 195 comprising a plurality of through perforations 197 which connect the internal volume V with a second cavity 156 delimited between the turbine ring 11 and the plate 195. The multi-perforated plate 195 is situated opposite (facing) the external face 112 B of the ring segment 110. The multi-perforated plate 195 has, in the example illustrated, an elongate form along the circumferential direction $D_C$ of the turbine ring 11. The multi-perforated plate 195 also emerges between the first 114 and second 116 attachment tabs of the ring segment 110. No third element is present between the multi-perforated plate 195 and the external face 112*b* of the ring segment 110 so as not to slow down or disturb the flow of cooling air passing through the plate 195 and impacting the ring segment 110. The multi-perforated plate 195 delimits the internal volume V and is situated on the side of the ring segment 110 (radially inward). The element 150 also comprises a cooling air guiding portion 157 which extends from the body 153 both in the radial direction $D_R$ and in the axial direction $D_A$. The guiding portion 157 is positioned radially outward in relation to the multi-perforated plate 195. This guiding portion 157 defines an internal channel which communicates with the cooling air supply orifices 192 and 190 respectively formed in the first 133 and second 134 upstream flanges. The cooling air flow $F_R$ taken upstream in the turbine is intended to pass through the orifices 190 and 192 in order to be routed up to the ring segment 110. The guiding portion 157 defines an internal channel 194 that the cooling air flow $F_R$ is intended to pass through in order to be transferred to the internal volume V and be distributed to the ring segment 110 after having passed through the multi-perforated plate 195. The internal channel 194 has an inlet orifice 191 which is situated opposite (facing) the supply orifice 192 and communicating therewith. It can be beneficial for the inlet orifice 191 to be in the extension of the supply orifice 192, the guiding portion 157 being in this case in contact with or with very little spacing from the first upstream flange 133. The internal channel 194 emerges also in the internal volume V through the outlet orifice 193. The outlet orifice 193 emerges, in the example illustrated, facing the multi-perforated plate 195. The purpose of the internal channel 194 of the guiding portion 157 is to channel the cooling air $F_R$ arriving through the orifice 192 in order to transfer it into the internal volume V then towards the ring segment 110 and thus minimize the losses or leaks of this cooling air.

The guiding portion 157 defines a housing 158 that is a through housing in the present case, but which could as a variant be blind. A fixing screw 163 is intended to cooperate with this housing 158 in order to ensure the fixing of the element 150 to the ring support structure. As can be seen in particular in FIG. 1, the distribution element 150 further comprises an additional holding portion 159 distinct from the guiding portion 157 (the portion 159 does not necessarily define any internal route channel for the coolant). The portions 157 and 159 of one and the same distribution element 150 are staggered along the circumferential direction $D_C$. The holding portion 159 for its part also defines a housing 154 cooperating with a fixing screw 163 in order to allow the element 150 to be fixed to the ring support structure 13. In the example illustrated, the fixing screws 163 extend along the axial direction $D_A$ of the turbine ring and pass through the first 133 and second 134 upstream flanges when they are housed in the housings 154 and 158.

There now follows a description of a method for producing a turbine ring assembly corresponding to that represented in FIG. 1.

When the ring segments 110 are produced in CMC material, the latter are produced by formation of a fibrous preform having a form approximating that of the ring segment and densification of the ring segment with a ceramic matrix.

To produce the fibrous preform, it is possible to use threads of ceramic fibres, for example threads of SiC fibres such as those marketed by the Japanese company Nippon Carbon under the designation "Hi-Nicalon S", or threads of carbon fibres.

The fibrous preform is beneficially produced by three-dimensional weaving, or multilayer weaving with the provision of separation areas making it possible to separate the preform parts corresponding to the tabs 114 and 116 of the segments 110.

The weaving can be of interlock type, as illustrated. Other three-dimensional or multilayer weaves can be used such as, for example, multi-fabric or multi-satin weaves. Reference will be able to be made to the document WO 2006/136755.

After weaving, the blank can be shaped to obtain a ring segment preform which is consolidated and densified by a ceramic matrix, the densification being able to be performed in particular by chemical vapour infiltration (CVI) which is well known in itself. In a variant, the textile preform can be a little hardened by CVI for it to be sufficiently rigid to be handled, before making the liquid silicon rise by capillarity into the fabric to cause the densification.

A detailed example of the manufacture of ring segments made of CMC is described in particular in the document US 2012/0027572.

The manufacture of the ring segments made of CMC material which has just been described is valid for the first, the second or the third example of ring assembly described above when this assembly implements a ring made of CMC material.

When the ring segments 110 are made of metal material, the latter can for example be formed by one of the following materials: alloy AM1, alloy C263 or alloy M509.

The ring support structure 13 is, for its part, produced in a metal material such as a Waspaloy® or Inconel 718 alloy or even alloy C263.

The production of the turbine ring assembly continues with the mounting of the ring segments 110 on the ring support structure 13. This mounting can be performed ring segment by ring segment as follows.

First of all, the first pins 119 are placed in the orifices 13350 provided in the third part 1335 of the first upstream flange 133, and the ring segment 110 is mounted on the first upstream flange 133 by engaging the first pins 119 in the orifices 1170 of the first lugs of the upstream attachment tab 114 until the first portion 1333 of the first upstream flange 133 is bearing against the bearing surface 1110 of the upstream face 114*a* of the upstream attachment tab 114 of the ring segment 110.

The second upstream flange 134 is then fixed to the first upstream flange 133 and to the element 150 present between the tabs 114 and 116 by positioning the fixing screws 163 through the orifices 13440, 13340, 154 and 158.

The two second pins 120 are then inserted into the two orifices 13650 provided in the third part 1365 of the annular radial collar 136 of the ring support structure 13.

The assembly comprising the ring segment 110, the flanges 133 and 134 and the element 150 previously obtained 1 is then mounted on the ring support structure 13 by inserting each second pin 120 into each of the orifices 1180 of the second lugs 118 of the downstream radial attachment tabs 116 of the ring segment 110. During this mounting, the second portion 1334 of the first upstream flange 133 is placed bearing against the upstream annular radial collar 132.

The mounting of the ring segment is then finalized by inserting the fixing screws 160 into the orifices 13440, 13340 that are still free and coaxial 1320, and each of the screws is tightened into the nuts 161 secured to the ring support structure.

The example of production which has just been described comprises, for each ring segment 110, two first pins 119 and two second pins 120. There is however no departure from the scope of the invention if, for each ring segment, two first pins 119 and a single second pin 120 or a single first pin 119 and two second pins 120 are used.

Figure 4:
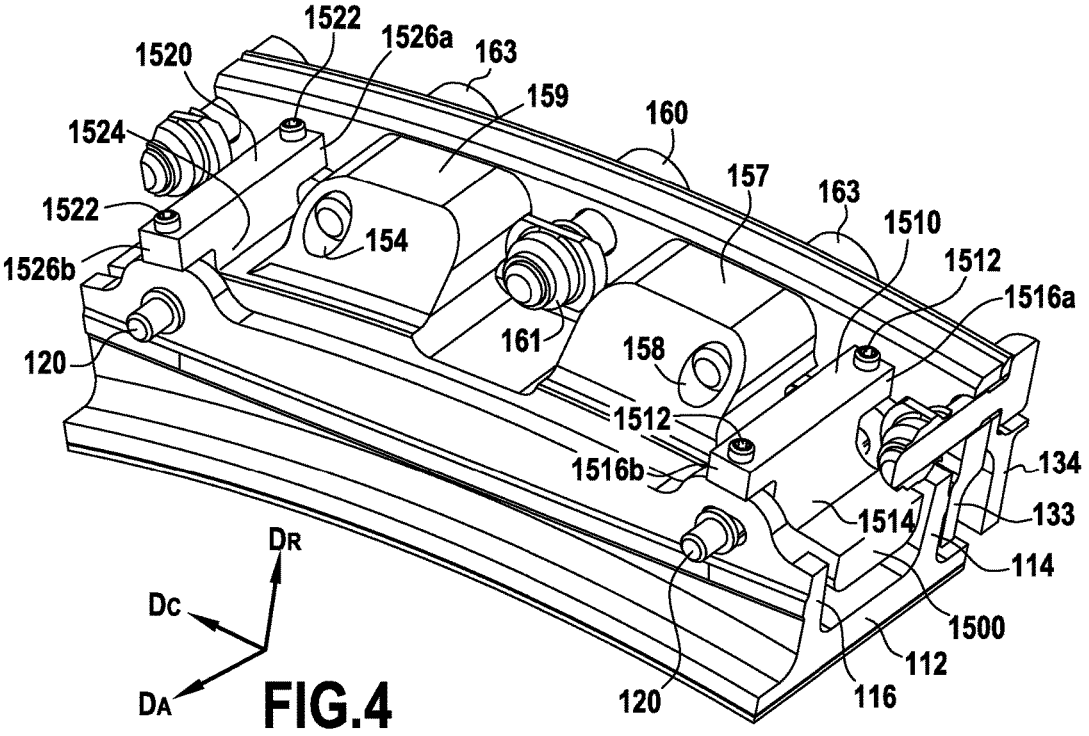
FIG. 4 is a perspective partial and schematic view of a variant of a turbine ring assembly according to the first example described above.

Description of a Second Embodiment of the First Example of Turbine Ring Assembly FIG. 4 illustrates a second embodiment of the first turbine ring assembly. This second embodiment differs from the first embodiment previously described only in that each distribution element 1500 further comprises two holed blocks 1510 and 1520 which each extend in the axial direction $D_A$ and which are staggered along the circumferential direction $D_C$. The body of the distribution element has, in this example, two radial extensions 1514 and 1524 connected respectively to the block 1510 and to the block 1520. The first block 1510 has axial ends 1516*a* and 1516*b* which come to block the attachment tabs 114 and 116 against a radially outward movement. The ends 1516*a* and 1516*b* of the first block each have a through hole in which is received a pin 1512 extending radially and making it possible to hold the attachment tabs 114 and 116 in radial position. Similarly, the ends 1526*a* and 1526*b* each receive a pin 1522 having the same function.

Figure 3:
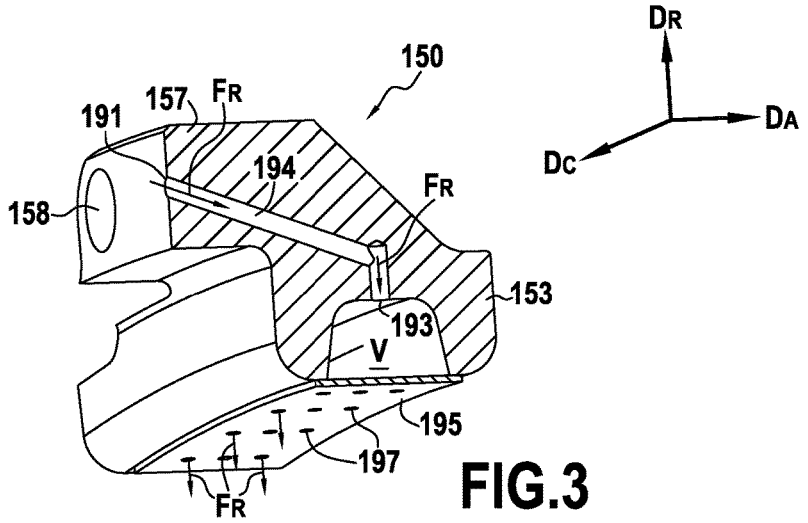
FIG. 3 is a perspective cross-sectional view of the distribution element implemented in the turbine ring assembly of FIGS. 1 and 2.

In a variant not illustrated, it would also be possible to use a distribution element 150 having the same structure as that described in FIGS. 1 to 3 (not comprising the blocks 1510 and 1520) and pins extending in the radial direction between the central crown ring 131 and the attachment tabs 114 and 116 in order to hold these tabs in radial position. According to this variant, the ends of these pins are forced-fitted into orifices produced in the central crown ring 131 in order to ensure their hold. As a variant, these pins could be mounted with a play in the orifices of the central crown ring 131 then be welded afterwards.

Description of an Embodiment of the Second Example of Turbine Ring Assembly

In this second example of turbine ring assembly, some elements are common to the first example previously described. The description of these common elements is not repeated in the interests of conciseness. These common elements are referenced in this second example by the same reference except that they begin with a "2" instead of a "1". Thus, for example, the screws referenced 160 in the first example will be referenced 260 in the second example.

Figure 5:
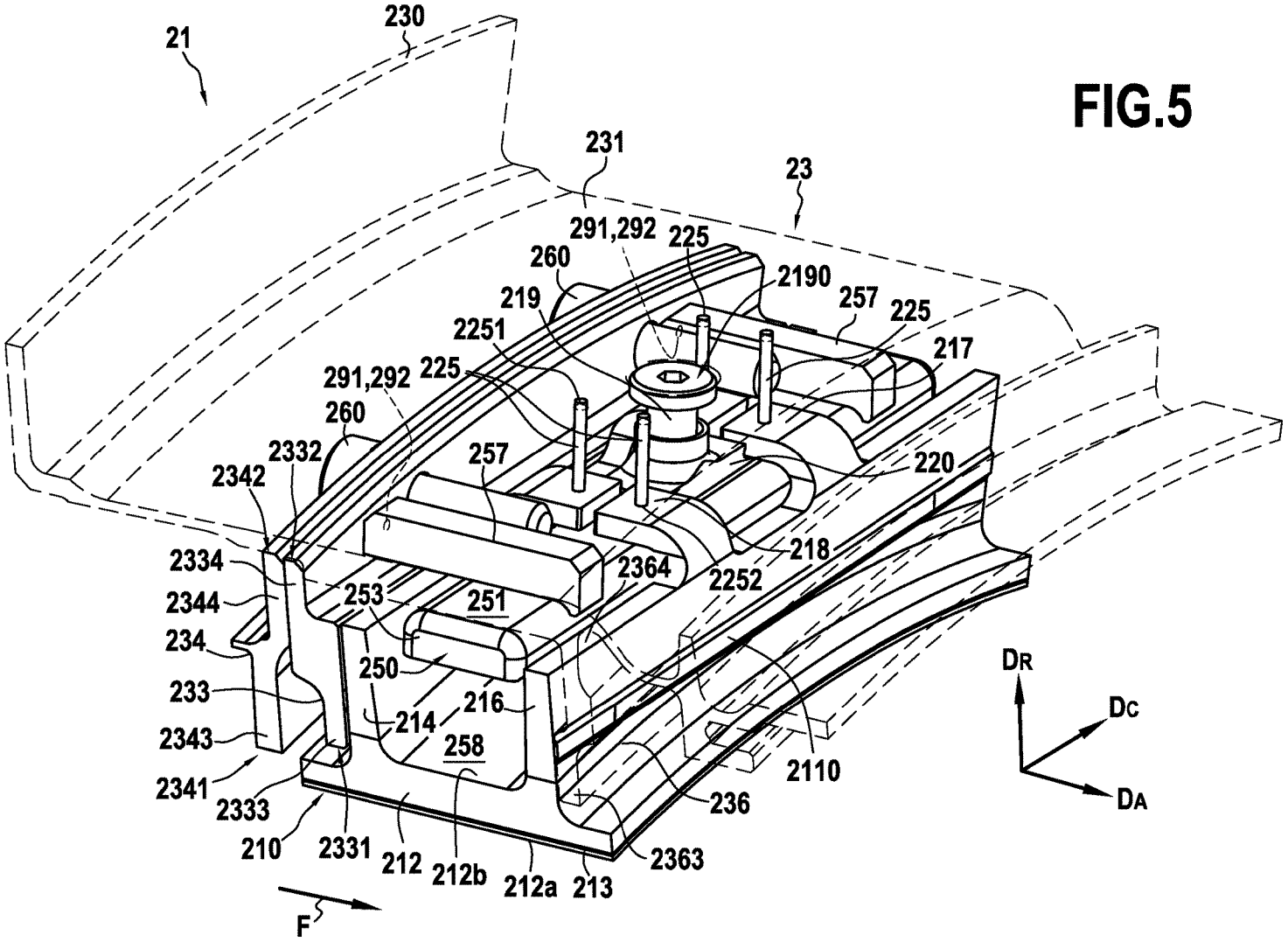
FIG. 5 is a perspective schematic view of an embodiment of a turbine ring assembly according to the second example described above.
Figure 6:
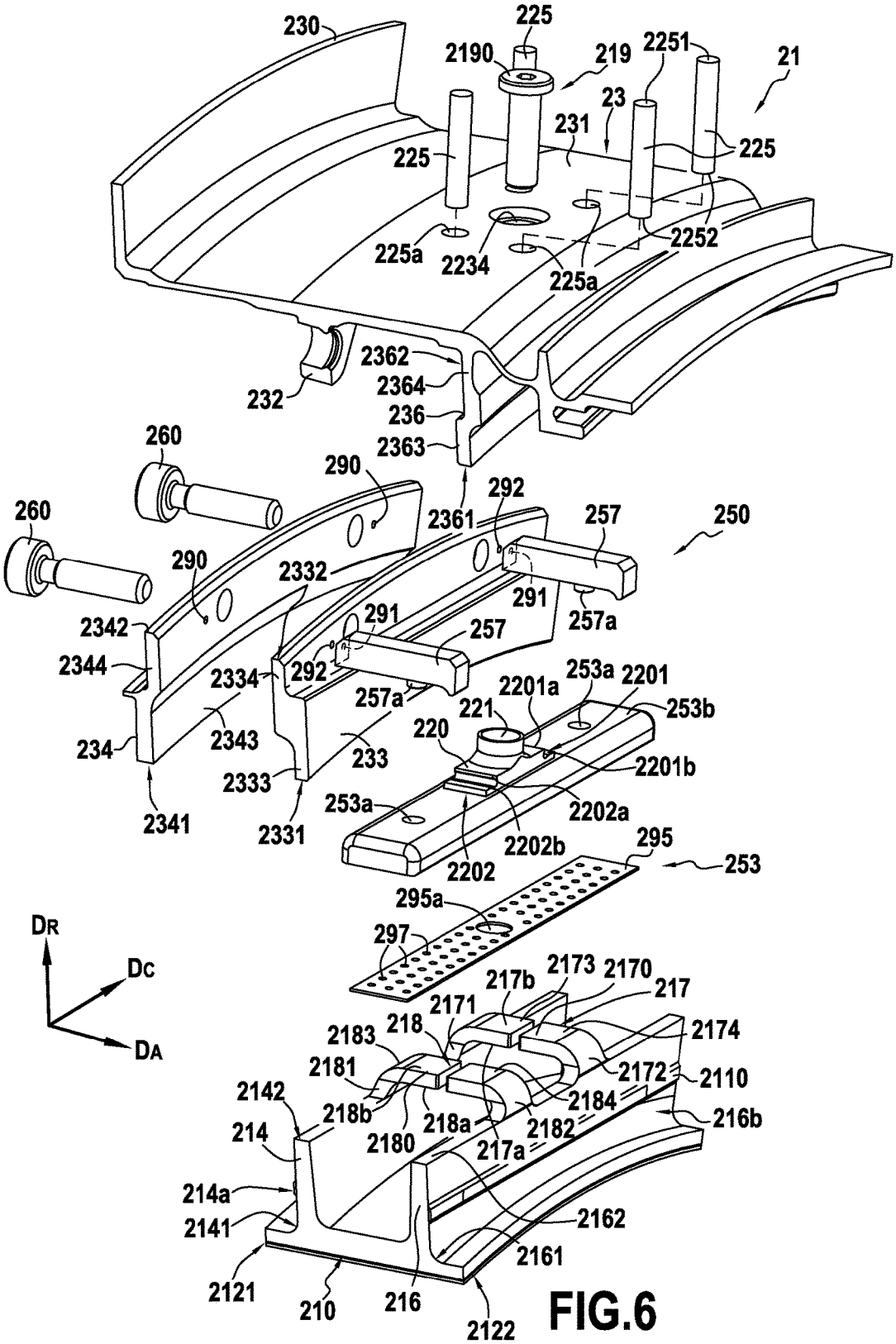
FIGS. 6 and 7 are exploded perspective schematic views of the turbine ring assembly of FIG. 5.
Figure 7:
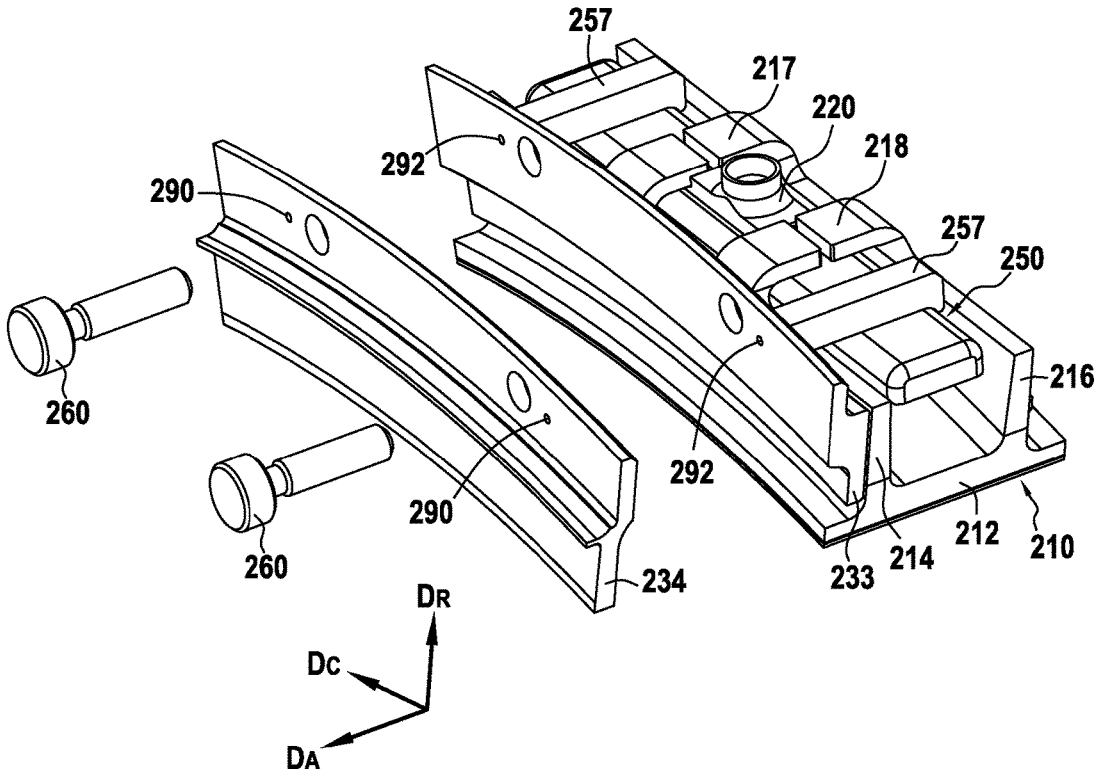

As is illustrated in FIGS. 5 to 7, the ring segment 210 comprises, in this second example, two axial attachment tabs 217 and 218 extending between the upstream and downstream radial attachment tabs 214 and 216.

Each of the upstream and downstream radial attachment tabs 214 and 216 comprises a first end, 2141 and 2161, secured to the external face 212*b* of the annular base 212 and a free second end 2142 and 2162. The axial attachment tabs 217 and 218 extend, more specifically, in the axial direction $D_A$, between the second end 2142 of the upstream radial attachment tab 214 and the second end 2162 of the downstream radial attachment tab 216.

Each of the axial attachment tabs 217 and 218 comprises an upstream end, respectively 2171 and 2181, and a downstream end, respectively 2172 and 2182, the two ends, 2171 and 2172 on the one hand and 2181 and 2182 on the other hand, of an axial attachment tab 217 or 218 being separated by a central part, 2170 and 2180. The upstream and downstream ends, 2171 and 2172 on the one hand and 2181 and 2182 on the other hand, of each axial attachment tab 217 and 218 extend protrudingly, in the radial direction $D_R$, from the second end 2142, 2162 of the radial attachment tab 214, 216 to which they are coupled, so as to have a central part 2170 and 2180 of axial attachment tab 217 and 218 raised in relation to the second ends 2142 and 2162 of the upstream and downstream radial attachment tabs 214 and 216.

In the embodiment illustrated in FIGS. 5 to 7, each of the axial attachment tabs 217 and 218 is cut into two, forming an upstream part, respectively 2173 and 2183, and a downstream part, respectively 2174 and 2184.

As illustrated in FIGS. 5 to 7, for each ring segment 210, the turbine ring assembly comprises a screw 219 and a fixing plate 220. The fixing plate 220 comprises a first and a second ends 2201 and 2202 respectively bearing against the first and the second axial attachment tabs 217 and 218.

The first and second ends 2201 and 2202 of the fixing plate 220 each comprise a cutout forming a first rotational abutment, respectively 2201*a* and 2202*a*, that is to say an abutment in a direction orthogonal to the cutting plane comprising the axial direction $D_A$ and the radial direction $D_R$, and a second radial abutment, respectively 2201*b* and 2202*b*, forming more particularly an abutment in the radial direction $D_R$ in a direction going towards the centre of the ring 1. The cutout of each end 2201 and 2202 thus cooperates with a distinct axial attachment tab 217 or 218 to come to bear on both sides at once of one and the same edge of the axial attachment tab 217 or 218.

The fixing plate 220 thus offers a radial hold for the duct by exerting a radial force using the two radial abutments 2201*b* and 2202*b* bearing on the internal face 217*a* and 218*a*, in the radial direction $D_R$, of each of the two axial attachment tabs 217 and 218. The fixing plate 220 also blocks the ring segment 210, and therefore the ring 21, from any rotation about the axis of the turbine, because of the bearing of the two axial attachment tabs 217 and 218 on two opposite sides of the fixing plate 220.

The fixing plate 220 also comprises an orifice 221 provided with a tapping cooperating with a threading of the screw 219 to fix the fixing plate 220 to the screw 219. The screw 219 comprises a screw head 2190 cooperating with an orifice 2234 produced in the central crown ring 231 of the ring support structure 23 through which the screw 219 is inserted before being screwed to the fixing plate 220.

The radial securing of the ring segment 210 with the ring support structure 23 is performed using the screw 219, whose head 2190 is bearing on the central crown ring 231 of the ring support structure 23, and the fixing plate 220, screwed to the screw 219 and whose ends 2201 and 2202 are bearing against the axial attachment tabs 217 and 218 of the ring segment 210.

To radially block the ring segment 210 in a direction opposite to that of the forces exerted by the second abutments 2201*b* and 2202*b*, the turbine ring assembly comprises, in this embodiment, four pins 225 extending in the radial direction $D_R$ between the central crown ring 231 of the ring support structure 23 and the axial attachment tabs 217 and 218 of the ring 21. More specifically, the pins 225 comprise first ends 2251 force-fitted into orifices 225*a* produced in the central crown ring 231 around the orifice 2234 receiving the fixing screw 219. In a variant, the pins could also be shrink-fitted in the orifices 225*a* by known metal mountings such as fits H6-P6 or by contracting the pins in a cold fluid (for example nitrogen) before mounting or else held in the orifices by screwing, the pins 225 in this case comprising a threading cooperating with a tapping formed in the orifices 225*a*. The pins 225 could even be mounted with a play in the orifices 225*a* and then be welded.

The four pins 225 are distributed symmetrically in relation to the screw 219 so as to have two pins 225 extending between the first axial attachment tab 217 and the ring support structure 23 and two pins 225 extending between the second axial attachment tab 218 and the ring support structure 23. The pins 225 are dimensioned and installed for a second end 2252 of each pin 225, opposite the first end 2251, to come to bear on the associated axial attachment tab 217 or 218, more particularly on the corresponding external face 217*b* or 218*b*, thus radially blocking, with the help of the fixing plate 220, the axial attachment tabs 217 and 218, and therefore the ring 21, in both directions of the radial direction $D_R$ of the ring 21.

The ring assembly further comprises, for each ring segment 210, a cooling air distribution element 250 having a function similar to the distribution element 150 described above. The element 250 here comprises a plurality of cooling air guiding portions 257 which extend from the body 253 both in the radial direction $D_R$ and in the axial direction $D_A$. These guiding portions 257 each define an internal channel which is in communication with the cooling air supply orifices 292 and 290 respectively formed in the first 233 and second 234 upstream flanges. The guiding portions 257 define an internal channel that the cooling air flow is intended to pass through in order to be transferred to the internal volume and be distributed to the ring segment 210 after having passed through the multi-perforated plate 295. The internal channel has an inlet orifice 291 which is situated opposite (facing) the supply orifice 292 and communicating therewith. The internal channel also emerges in the internal volume through an outlet orifice defined by the relief 257*a*. This outlet orifice emerges, in the example illustrated, facing the multi-perforated plate 295. The guiding portions 257 are fixed to the body by insertion of the reliefs 257*a* into the orifices 253*a* defined by the body 253. According to a variant, the guiding portions 257 could be formed monolithically (in a single piece) with the body 253.

The distribution element 250 is here welded to the fixing plate 220 at the level of a fixing portion 253*b* situated radially outward in relation to the multi-perforated plate 295. The plate 295 also has an orifice 295*a* intended to cooperate with the fixing screw 219. In this second example, the distribution element 250 is fixed to the ring support structure 23 by an added element, consisting of the screw 219, which cooperates with a housing defined by the body 253 and the fixing plate 295 and which extends in the radial direction $D_R$.

An example of how to mount the ring segments 210 on the ring support structure 23 will now be described.

For that, the ring segments 210 are assembled together on an annular tool of "spider" type comprising, for example, suckers configured to each hold a ring segment 210. Then, the fixing plates 220 welded to an associated distribution element 250 are inserted into each of the free spaces extending between a first and a second axial attachment tabs 217 and 218 of a ring segment 210. Until it is screwed to the ring support structure 23, each fixing plate 220 is held in position bearing against the axial attachment tabs 217 and 218 of the associated ring segment using a holding tab mounted on the annular tool. The annular tool comprises a holding tab for each fixing plate 220, that is to say for each ring segment 210. Each holding tab is inserted between the two axial attachment tabs 217 and 218, on the one hand, and between the second end 2162 of the downstream radial attachment tab 216 and the fixing plate 220 on the other hand. Each holding tab is then adjusted to hold the associated fixing plate 220 bearing against the axial attachment tabs 217 and 218. Each fixing screw 219 is then inserted into the associated orifice 2234 of the central crown ring of the ring support structure 23 and screwed into the tapped hole 221 of the associated fixing plate 220 and into the orifice 295*a* until the screw head 2190 is bearing against the central crown ring 231. The pins 225 are also introduced in such a way that the ring segment is held radially. The first and the second flanges 233 and 234 are then fixed to the upstream annular radial collar 232 using the screws 260 to axially hold the turbine ring 1, then the annular tool is removed.

Description of an Embodiment of the Third Example of Turbine Ring Assembly

Figure 8:
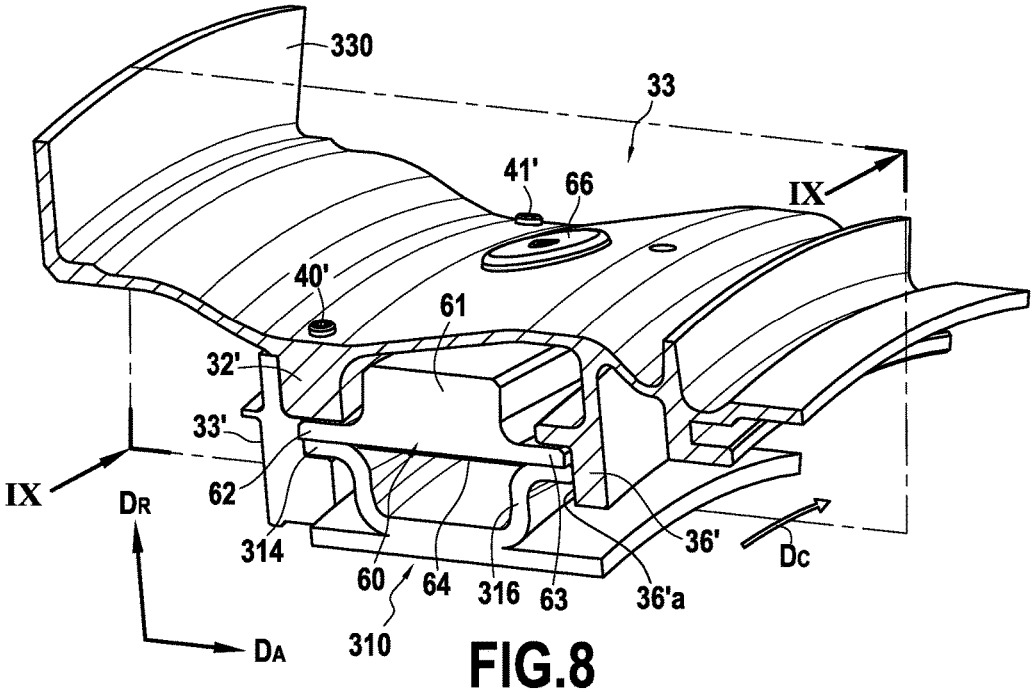
FIG. 8 is a perspective partial and schematic view of a turbine ring assembly according to the third example described above.

FIG. 8 shows a high-pressure turbine ring assembly according to the third example comprising a turbine ring made of CMC material or of metal material and a metal ring support structure 33. The turbine ring is formed of a plurality of ring segments 310.

Figure 9:
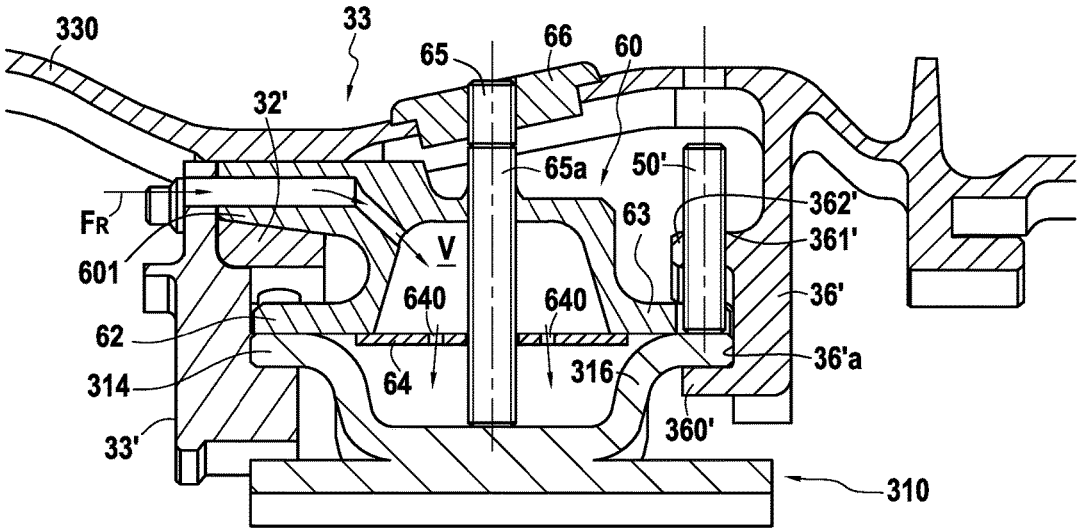
FIG. 9 is a cross-sectional view along IX-IX of the turbine ring assembly of FIG. 8.
Figure 10:
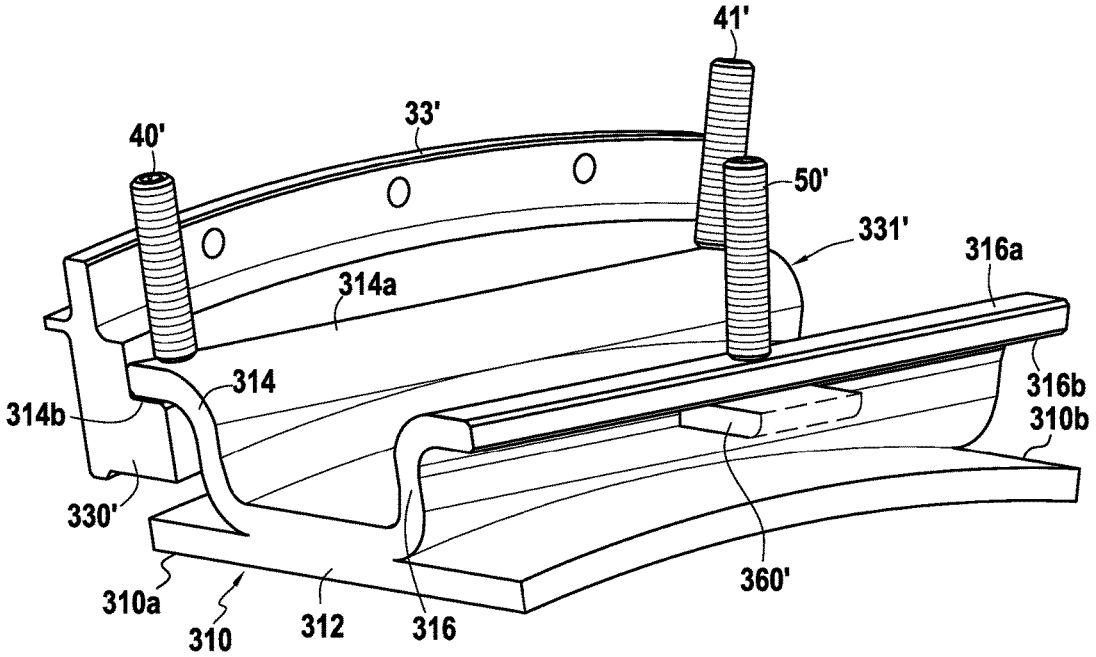
FIG. 10 is a perspective partial view of the turbine ring assembly of FIG. 8.

Each ring segment 310 has, as illustrated in FIGS. 8 to 10 and along a plane defined by the axial DA and radial DR directions, a section substantially in the form of a K comprising an annular base 312, upstream and downstream tabs 314, 316 substantially in the form of an S extend, in the direction DR, from the external face of the annular base 312.

The ring support structure 33, which is secured to a turbine casing 330, comprises an upstream annular radial collar 33' and a downstream annular radial collar 36' which extend in the radial direction DR towards the centre of the ring and in the circumferential direction of the ring. In the example described here, the ring support structure 33 further comprises an upstream flange 33', in the form of a ring, the upstream flange 33' being mounted on the upstream annular radial collar 32'. In the interests of clarity, FIG. 8 shows only a part of the turbine ring, of the ring support structure 33 and of the flange 33', these elements extending in reality in a complete annular form, a plurality of adjacent ring segments 310 being disposed between the collars 33' and 36' of the ring support structure.

The upstream and downstream tabs 314, 316 of each ring segment 310 extend in a rectilinear direction (in the axial direction DA) whereas the annular base 312 of each segment extends in the circumferential direction DC of the turbine ring.

Figure 11:
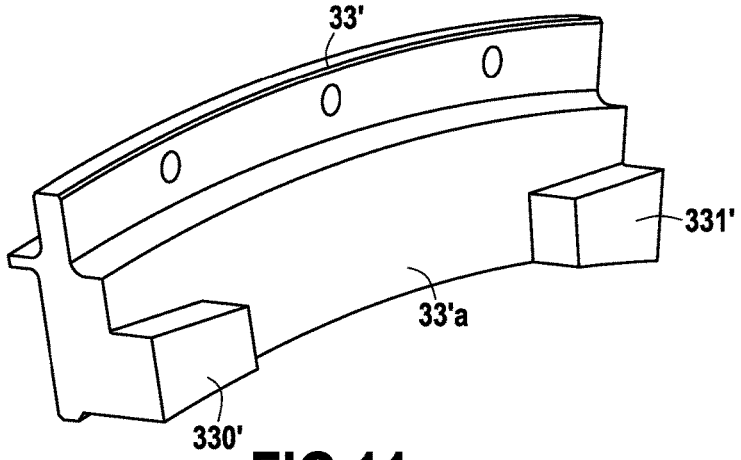
FIG. 11 represents the upstream flange used in the turbine ring assembly of FIG. 8.

In the example described here, the internal face 314*b* in the radial direction DR of the turbine ring of the first tab 314 of each ring segment 310 rests on a first and second holding elements secured to the annular upstream radial collar 32', corresponding here to a first and a second snugs 330' and 331' protruding from the face 33'*a* of the upstream flange 33' (FIGS. 10 and 11) facing the upstream tab 314 of the ring segments 310.

The first and second snugs 330' and 331' are distributed evenly over the flange 33' at determined positions so as to be present in the vicinity of the circumferential ends 310*a* and 310*b* of each ring segment 310. With the upstream flange 33' being mounted on the upstream annular radial collar 32', the snugs 330' and 331' are secured to the upstream annular radial collar 32'.

Furthermore, the external face 314*a* in the radial direction DR of the turbine ring of the upstream tab 314 of each ring segment 310 is in contact with a first and a second tightening elements secured to the ring support structure 33, here first and second pins 40' and 41'. The first and second pins 40' and 41' are placed respectively facing the first and second snugs 330' and 331' in the radial direction DR of the turbine ring. The pins 40' and 41' are held respectively in orifices formed in the collar 32'.

The pins 40' and 41' can be shrink-fitted in the orifices of the collar 32' by known metal mountings such as fits H6-P6 or other force-fittings, or even by contracting the pins by putting them into contact with a cold fluid (liquid nitrogen) which allow these elements to be held cold or held in the orifices by screwing. The pins 40' and 41' in this case comprise a threading cooperating with a tapping formed in the orifices of the collar 32'.

The internal face 316*b* in the radial direction DR of the turbine ring of the second tab 316 of each ring segment 310 rests on a third holding element secured to the annular radial collar 36', corresponding here to a third snug 360' (FIG. 10) protruding from the face 36'*a* of the collar 36' facing the downstream tab 316 of the ring segments 310. The third snugs 360' are distributed evenly over the face 36'*a* of the annular radial collar 36' at a determined position so as to be present in the vicinity of the median part of each ring segment 310.

Furthermore, the external face 316*a* in the radial direction DR of the turbine ring of the downstream tab 316 of each ring segment 310 is in contact with a third tightening element secured to the ring support structure 33, here a third pin 50'. The third pin 50' is placed respectively facing the third snug 360' in the radial direction DR of the turbine ring. The pin 50' is held in an orifice 361' formed in a protuberance 362' present on the face 36'*a* of the downstream annular radial collar 36' facing the tabs 316 of the ring segments 310.

The pin 50' can be shrink-fitted in the orifice 361' by known metal mountings as described above which allow this element to be held cold, or held in the orifice by screwing, the pins 50' comprising in this case a threading cooperating with a tapping formed in the orifice 361'.

In the example described here, each ring segment 310 is held in the ring support structure at three holding points, a first holding point being formed by the snug 330' and the facing pin 40' a second point being formed by the snug 331' and the facing pin 41' and a third point being formed by the snug 360' and the facing pin 50' as represented in FIG. 10 in particular.

The tightening elements, here the pins 40', 41' and 50', can for example be produced in metal material.

By virtue of the use of the tightening elements, such as the pins 40', 41' and 50', it is possible to adjust the bearings cold between the ring segments and the ring support structure. "Cold" should be understood in the present invention to mean the temperature at which the ring assembly is when the turbine is not operating, that is to say at an ambient temperature which can for example be approximately 25° C. "Hot" should be understood here to mean the temperatures to which the ring assembly is subjected when the turbine is operating, these temperatures being able for example to lie between 600° C. and 1500° C., for example between 600° C. and 900° C.

In the example which has just been described, two holding elements and two tightening elements are present on the side of the upstream annular radial collar whereas a holding element and a tightening element are present on the side of the downstream annular radial collar. The invention applies also to a turbine ring assembly in which two holding elements and two tightening elements are present on the side of the downstream annular radial collar whereas a holding element and a tightening element are present on the side of the upstream annular radial collar.

By virtue of the rectilinear form of the tabs of each ring segment, the bearings or contact areas between the holding elements (for example the snugs) and the tabs lie in one and the same rectilinear plane. Similarly, the bearings or contact areas between the tabs and the tightening elements (for example the pins) lie in one and the same rectilinear plane. The rings in operation rock about a normal to the plane (DA; DR). A curvilinear bearing would generate a ring segment/ring support structure contact on one or two points whereas a rectilinear bearing is beneficial because it allows a bearing on a line.

FIGS. 8 and 9 also illustrate the fact that the ring assembly comprises a plurality of cooling air distribution elements 60 intended to allow a cooling flow to impact on the internal face of the turbine ring. Each element 60 comprises a hollow body 61 delimiting an internal volume V. First and second tabs 62 and 63 extend on each side of the body 61, the first tab 62 being held between the upstream annular radial collar 32' of the ring support structure 33 and the tab 314 of the ring segments 310 whereas the second tab 63 is held between the downstream annular radial collar 36' of the ring support structure 33 and the tab 316 of the ring segments 310. Each element 60 is also held in position inside the ring support structure 33 by a pin 65 secured to a cap 66 fixed to the ring structure 33. The pin 65 exerts a bearing on a pin 65*a* passing through the body 61 in order to hold the element 60 in position. The distribution element 60 is also held in position by the bearing of the tabs 62 and 63 on the tabs 314 and 316. The pin 65*a* extends in the radial direction DR and also comes to bear on the ring segment 310 so as to hold the latter in position in the radial direction.

The internal volume V is closed in its lower part by a plate 64 comprising a plurality of perforations 640. A cooling air flow FR taken upstream in the turbine is guided as far as into the volume V by a guiding portion 601 (FIG. 9). The flow FR then passes through the perforations 640 of the plate 64 in order to cool the internal face of the ring segments 310 forming the turbine ring.

An example of how to mount the ring segments 310 on the ring support structure 33 will now be described.

The assembly consisting of a ring segment 310 and the element 60 is brought closer to the ring support structure 33 so as to place the internal face 316*b* of the tab 316 on the snug 360'. The pin 50' is then introduced so as to hold the tab 316 on the collar 36'. The pins 40' and 41' are positioned in the annular collar 32'. The upstream flange 33' is then mounted on the upstream annular radial collar 32'. Because of the significant aerodynamic loads, the distributor will push the flange 33' and "press" it on the upstream collar 32'. Once the flange 33' is mounted, the internal face 314*b* of the tabs 314 of each segment 310 rests on the snugs 330' and 331'. The pins 40' and 41' will then make it possible to fix the ring segment. The mounting is then finalized by positioning the pins 65*a* and 65 and the cap 66.

The invention claimed is:

1. Turbine ring assembly comprising a plurality of ring segments made of ceramic matrix composite material or of metal material forming a turbine ring and a ring support structure, each ring segment having, along a cutting plane defined by an axial direction and a radial direction of the turbine ring, a part forming an annular base with, in the radial direction of the turbine ring, an internal face defining the internal face of the turbine ring and an external face from which extend a first and a second attachment tabs, the ring support structure comprising a first and a second radial tabs between which are held the first and second attachment tabs of each ring segment, as well as a plurality of cooling air supply orifices, the turbine ring assembly further comprising, for each ring segment, a cooling air distribution element fixed to the ring support structure and positioned in a first cavity delimited between the turbine ring and the ring support structure, said distribution element comprising a body defining an internal cooling air distribution volume (V) and comprising a multi-perforated plate communicating with the internal volume and emerging in a second cavity delimited between the turbine ring and the multi-perforated plate, the distribution element further comprising at least one cooling air guiding portion extending from the body and defining an internal channel communicating with one of the cooling air supply orifices and emerging in the internal cooling air distribution volume, each ring segment having, in cross section along the plane defined by the axial and radial directions, the form of a K, the first and second attachment tabs each having the form of an S, the first radial tab comprising a first and a second holding elements on which rests the internal face in the radial direction of the first attachment tab of each ring segment, the external face in the radial direction of the turbine ring of said first attachment tab of each ring segment being in contact with a first and a second tightening elements secured to the ring support structure, the first and second tightening elements being respectively facing the first and second holding elements in the radial direction, the second radial tab comprising a third holding element on which rests the internal face in the radial direction of the second attachment tab of each ring segment, the external face in the radial direction of the turbine ring of said second attachment tab of each ring segment being in contact with a third tightening element secured to the ring support structure, the third tightening element being facing the third holding element in the radial direction.

2. Assembly according to claim 1, in which the body of the distribution element extends along a circumferential direction of the turbine ring and the multi-perforated plate emerges between the first and second attachment tabs of the ring segment.

3. Assembly according to claim 1, in which the distribution element comprises at least one holding element extending along the radial direction of the turbine ring and coming to bear against the ring segment so as to hold the latter in position in the radial direction.

4. Assembly according to claim 1, in which the distribution element is fixed to the ring support structure by at least one added element cooperating with an orifice defined by the cooling air guiding portion and extending along the axial direction and/or by at least one added element cooperating with a housing defined by the body of the distribution element and extending along the radial direction.

5. Assembly according to claim 1, in which the first and second holding elements of the first radial tab are present in the vicinity of the circumferential ends of each ring segment whereas the third holding element of the second radial tab is present in the vicinity of the median part of each ring segment.

6. Assembly according to claim 1, in which the first and second attachment tabs of each ring segment extend in a rectilinear direction whereas the annular base of each ring segment extends in the circumferential direction of the ring.

7. Assembly according to claim 1, in which the areas of contact between the holding elements and the attachment tabs lie in one and the same rectilinear plane and in which the areas of contact between the attachment tabs and the tightening elements lie in one and the same rectilinear plane.

8. Turbomachine comprising a turbine ring assembly according to claim 1.

* * * * *